US008918929B2

(12) United States Patent
Kayser et al.

(10) Patent No.: US 8,918,929 B2
(45) **Date of Patent: *Dec. 30, 2014**

(54) INFANT CRIB HAVING PAIRED SETS OF VERTICALLY HINGED DOORS FOR CREATING OPENING ALONG ENTIRE SIDE WALL

(71) Applicants: Peter Kayser, Dorfmark (DE); Masood A Qurashi, Bethlehem, PA (US)

(72) Inventors: Peter Kayser, Dorfmark (DE); Masood A Qurashi, Bethlehem, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/041,166

(22) Filed: Sep. 30, 2013

(65) Prior Publication Data

US 2014/0026317 A1 Jan. 30, 2014

Related U.S. Application Data

(63) Continuation-in-part of application No. 13/483,642, filed on May 30, 2012, now Pat. No. 8,566,979.

(51) Int. Cl.
*A47D 7/01* (2006.01)
*A47D 7/00* (2006.01)

(52) U.S. Cl.
CPC ... *A47D 7/01* (2013.01); *A47D 7/00* (2013.01)
USPC ..... 5/100; 5/93.1

(58) Field of Classification Search
CPC ..... A47D 7/00–7/02
USPC ..... 5/93.1, 100, 424, 425, 430
See application file for complete search history.

(56) References Cited

U.S. PATENT DOCUMENTS

| | | | | |
|---|---|---|---|---|
| 2,477,231 | A * | 7/1949 | Bourdon | 5/93.1 |
| 3,403,412 | A | 10/1968 | Gottfried et al. | |
| 4,959,878 | A | 10/1990 | Essek | |
| 6,938,286 | B1 | 9/2005 | Smith | |
| 7,426,758 | B1 * | 9/2008 | Jones | 5/100 |
| 8,397,321 | B1 | 3/2013 | Smith | |
| 8,453,278 | B2 | 6/2013 | Aiken et al. | |
| 8,566,979 | B1 * | 10/2013 | Kayser et al. | 5/100 |

FOREIGN PATENT DOCUMENTS

| | | | |
|---|---|---|---|
| WO | WO 2011128697 | A1 * | 10/2011 |
| WO | WO 2013190865 | A1 * | 12/2013 |

* cited by examiner

*Primary Examiner* — Michael Trettel
(74) *Attorney, Agent, or Firm* — Sanford J. Piltch

(57) ABSTRACT

A displaceable sidewall of an infant crib made from outwardly rotatable bi-fold door sets that cooperate to open outward to provide limited or complete access to the bed space. Each of the doors has a latch mechanism to retain the doors in a closed position and the central doors have an interlocking locking and release means for ease of access and for maintaining the integrity of the sidewall when closed and locked.

20 Claims, 5 Drawing Sheets

INFANT CRIB HAVING PAIRED SETS OF VERTICALLY HINGED DOORS FOR CREATING OPENING ALONG ENTIRE SIDE WALL

CROSS REFERENCE TO RELATED APPLICATION

The instant application claims priority to, and incorporates expressly by reference, U.S. Non-Provisional patent application Ser. No. 13/483,642, filed on May 30, 2012, now U.S. Pat. No. 8,566,979, as if fully set forth herein.

BACKGROUND OF THE INVENTION

In recent years the safety of infant cribs has come into question. A variety of additional safety concerns have been identified and a new set of safety standards have been implemented. To this end, the previously, long known and used, drop-down sidewall has been disallowed for continued sale and use. Infant cribs now are required to have either fixed height side walls or sides that can be lowered but retain a minimum height above the mattress or mattress support deck. This has resulted in the redesign of infant cribs without a drop-down side for ease of access into the crib for the parent or caretaker.

The infant crib has been designed to allow for the vertical repositioning of the mattress and support deck as the child grows such that the support deck is lowered as the infant grows into a toddler. Some of the infant cribs, in addition to the mattress height adjustment, also convert to a youth bed so that the furniture can be used for a longer period of time. Other versions of the new crib designs have fold-down sides which are horizontally hinged, above a fixed lower section of the sidewall, along the top of the entire lower section of the sidewall from corner post to corner post with locking latches positioned at each post. This provides for slightly better access to the bed surface and the infant or toddler, but still constitutes a pinching hazard at the hinge point as the sidewall is folded back and locked into its vertical position.

It is, therefore, one object of the present invention to provide for greater ease of access to the infant bed surface and to the infant by creating either a partial or an entire sidewall opening along one side of the crib without the possibility of a pinching hazard. It is also an object of the present invention to provide only as much access to the infant bed surface as is required, so that only a part of the sidewall may be opened at any given time.

It is a further object of the present invention to provide individual locking elements to permit each section of the sidewall to be opened or to remain in its locked and closed position. It is a still further object of the present invention to provide a hinging system between each of the operable door sets and the infant crib that is pinch-proof so that this type of hazard is eliminated entirely. It is yet another object to provide latching mechanisms that are operable only from the exterior of the crib and that reset automatically when released.

It is also another object of the present invention to provide temporary door retention mechanisms to retain one or more of the doors in the open position so that the door does not move and impede access to the crib. In addition, it is another object of the present invention to provide door stops so the operable doors cannot be pushed into the crib and over the bed surface preventing any possible injury to an infant occupant.

Other objects will appear hereinafter.

SUMMARY OF THE INVENTION

An infant crib with a novel vertical door access system is presented to provide an increase in the ease of access to the bed space of the crib. Rather than a fixed front wall or a partial fold-down front wall, the paired door sets provide access to a portion or all of the bed space as may be desired by the parent or caretaker of the infant or toddler. Unique vertical hinging systems provide minimal interstitial spaces between the hinge and the doors or fixed corner posts to prevent pinching injury. Further, the hinges provide a fold-over overlap for the doors so that they can be moved out of the way for access to the bed space. The latching system permits the use of a single door for access, or more doors as is desired, and creates a substantially rigid front wall when latched in the closed and locked position.

The infant crib has top and bottom sides, rear and front sides and a sleep surface support deck connected between four respective corner posts creating a bed space within the defined space. The front side of the crib extends between two of the corner posts and is segregated into lower and upper sections. The lower section includes a lower rail and an upper rail extending between and connected to the corner posts with spindles spanning the vertical distance between the lower and upper rails. The spindles are laterally arrayed along the rails at uniformly spaced apart positions. The upper section includes a plurality of doors extending across the space between the corner posts. Each of the plurality of doors has along its outward edge an elongate cylindrical hinge for mounting to the corner post and being operable to open outward from and provide access to the bed space of the crib.

Each of the doors includes a latching means for securing the doors in a closed straight-line arrangement creating a substantially rigid upper front wall section for the infant crib. The latching means includes a spring operated latch pin that extends into a cooperating coaxially aligned receiving bore positioned in a reinforcing member atop the upper rail of the lower section. The latching means is mounted within each one of the plurality of doors and is manually operable by a handle extending through the surface of the door such that each latch pin can be retracted from said receiving bore and into each of said plurality of doors releasing each of said doors for outward rotational movement about said elongated hinges.

The latching means for securing the plurality of doors also includes a combination spring operated locking pin and cooperating slide lock that secures the inward most edges of the plurality of doors to each other in said closed straight-line arrangement. The spring operated locking pin and the cooperating slide lock are mounted within the left side centrally located door of the plurality of doors. The spring operated locking pin and the cooperating slide lock are each manually operable by a handle extending through the surface of the door such that said slide lock can be retracted from a coaxially aligned receiving bore in the right side centrally located door situated in adjacent edge abutting position releasing said doors for outward rotational movement about said elongated hinges. The spring operated locking pin and the cooperating slide lock interact by retracting the locking pin from a first recess in the slide lock, slidingly engaging or disengaging the slide lock from the receiving bore in the adjacent door, and inserting the locking pin into a second recess in the slide lock to retain the slide lock in a locked or unlocked position.

Each of the plurality of doors has a stop for preventing the doors from being pushed into the bed space of the infant crib. Each of the stops is positioned along the lower edge close to the inward facing edge of each of the doors and extends downward beyond the lower edge of the doors to contact the reinforcing member atop the upper rail of the lower section stopping each of the doors in alignment with the reinforcing member.

The invention can be more aptly described as a displaceable side wall of an infant crib. The displaceable side wall includes a lower section and an upper section as described above. The said lower section includes a lower rail and an upper rail extending between and connected to adjacent corner posts of said crib with spindles spanning the vertical distance between the lower and upper rails, said spindles being laterally arrayed along the rails at uniformly spaced apart position. The upper section includes a plurality of doors extending across the space between the corner posts. Each of the doors is capable of outward rotational movement about an attached elongated cylindrical hinge. The plurality of doors includes latching means for securing the plurality of doors in a closed straight-line arrangement creating a substantially rigid upper section of the side wall for the infant crib.

The plurality of doors are segregated into two opposite-hand opening groups of bi-fold doors, with each of said groups of bi-fold doors having inner and outer doors. Each of the inner and outer doors has along its edge closer to the nearest corner post an elongate cylindrical hinge for mounting to the adjacent door of the bi-fold door group or to the adjacent corner post. This hinge mounting enables the doors to be operable about said elongate cylindrical hinge so as to open outward from and provide access to the bed space of said crib.

The latching means also serves to secure the two opposite-hand opening groups of bi-fold doors and includes a combination spring operated locking pin and cooperating slide lock that secures the inward most adjacent edges of the inner doors to each other in said closed straight-line arrangement. The spring operated locking pin and said cooperating slide lock are mounted within a first one of said inner doors and are each manually operable by a handle extending through the surface of the door such that said slide lock can be retracted from a coaxially aligned receiving bore in a second one of said inner doors situated in adjacent edge abutting position to said first one of said inner doors releasing said doors for outward rotational movement. The spring operated locking pin and said cooperating slide lock interact by retracting said locking pin from a first recess in said slide lock, slidingly engaging or disengaging said slide lock from said receiving bore in said second one of said inner doors, and inserting said locking pin in a second recess in said slide lock to retain the slide lock in a locked or unlocked position.

The opposite-hand opening groups of bi-fold doors each have a stop for preventing said individual doors from being pushed into the bed space of the infant crib. Each of said stops is positioned along the lower edge close to the inward facing edge of each of the doors and extends downward beyond the lower edge of the doors to contact the reinforcing member atop the upper rail of the lower section stopping each of the doors in alignment with the reinforcing member. The outer doors of the groups of bi-fold doors have retention means for retaining the stop mounted to the inner door of the bi-fold doors in close proximate attachment when the bi-fold doors are overlaid one against the other.

An alternative latching system for securing the plurality of doors includes an interlocking locking and release means having a cooperating slide lock and an inwardly extending backstop along the rear inward facing edge of a first one of the center doors of the plurality of doors with a coaxially aligned receiver for accepting the extended pin of the slide lock and a cutaway bevel for receiving the backstop along the rear inward facing edge of a second one of the center doors of the plurality of doors. Also as part of the interlocking locking and release means is a spring operated latch pin mounted within the second one of the center doors with a coaxially aligned receiving bore positioned in a reinforcing member atop the upper rail of the lower section that secures the inward most edges of the plurality of doors to each other in the closed straight-line arrangement. The cooperating slide lock is manually operable by a handle extending to the surface of the first one of the center doors such that the slide lock can be retracted from the coaxially aligned receiver in the second one of the center doors situated in adjacent edge abutting position to the first one of the center doors for partially releasing the doors for outward rotational movement about said elongated hinges. The spring operated latch pin is manually operable by a handle extending to the surface of the door such that the latch pin can be retracted from the receiving bore and into the second one of the center doors releasing the second one of the center doors for outward rotational movement about the elongated hinge.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 2:
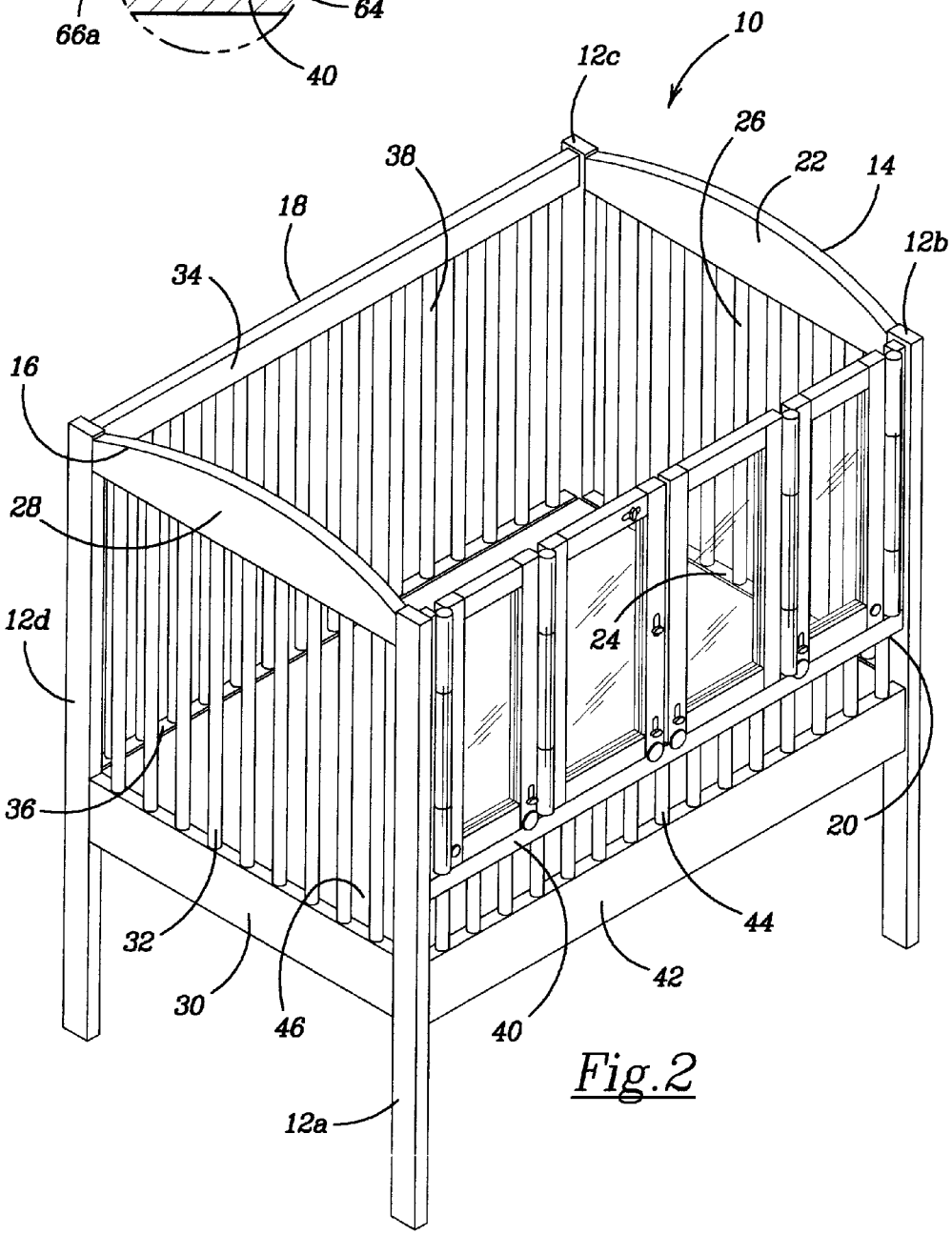
FIG. 2 is a perspective view of the infant crib of the present invention.

Referring now to the drawings in detail, where like numerals refer to like parts or elements, there is shown in FIG. 2 the infant crib 10 of the present invention. The structure of the crib 10 is rectangular in shape and includes four corner posts 12*a-d*, a top wall 14, a bottom wall 16, a backside or rear wall 18 and a front wall 20. The top wall 14 is composed of a top rail 22, a bottom rail 24 and a series of spindles 26 extending between the top rail 22 and the bottom rail 24 across the entire width of the top wall 14 between the corner posts 12*b* and 12*c*. Likewise, the bottom wall 16 is composed of a top rail 28, a bottom rail 30 and a series of spindles 32 extending between the top rail 28 and the bottom rail 30 across the entire width of the bottom wall 16 between the corner posts 12*d* and 12*a*. The backside or rear wall 18 is also composed of a top rail 34, a bottom rail 36 and a series of spindles 38 extending between the top rail 28 and the bottom rail 30 across the entire width of the rear wall 18 between the corner posts 12*c* and 12*d*. The front wall 20 is composed of two sections vertically arrayed one on top of the other. The lower section of the front wall 20 is composed of an upper rail 40, a bottom rail 42 and a series of spindles 44 extending between the upper rail 40 and the bottom rail 42 across the entire width of the front wall 20 between the corner posts 12*a* and 12*b*. The distance between each spindle of the grouping of spindles 26, 32, 38 and 44 and any spindle and a corner post 12*a-d* is less than the required minimum distance of the safety standard to prevent any entrapment of arms, legs or head of the occupant of the crib.

Spanning across the rectangular opening existing within the assembled structure of the infant crib 10 is a support deck 46 that will support the mattress or sleep surface 48 (not shown in this view). The lower section extends upward from the support deck 46 beyond the minimum vertical distance required by the new safety standard even with a mattress or sleep surface 48 in position on top of the support deck 46. The upper rail 40 of the lower section is configured to mate with and to support the interlocking of the paired door segments of the upper section of the front wall 20 as described below.

Figure 1:
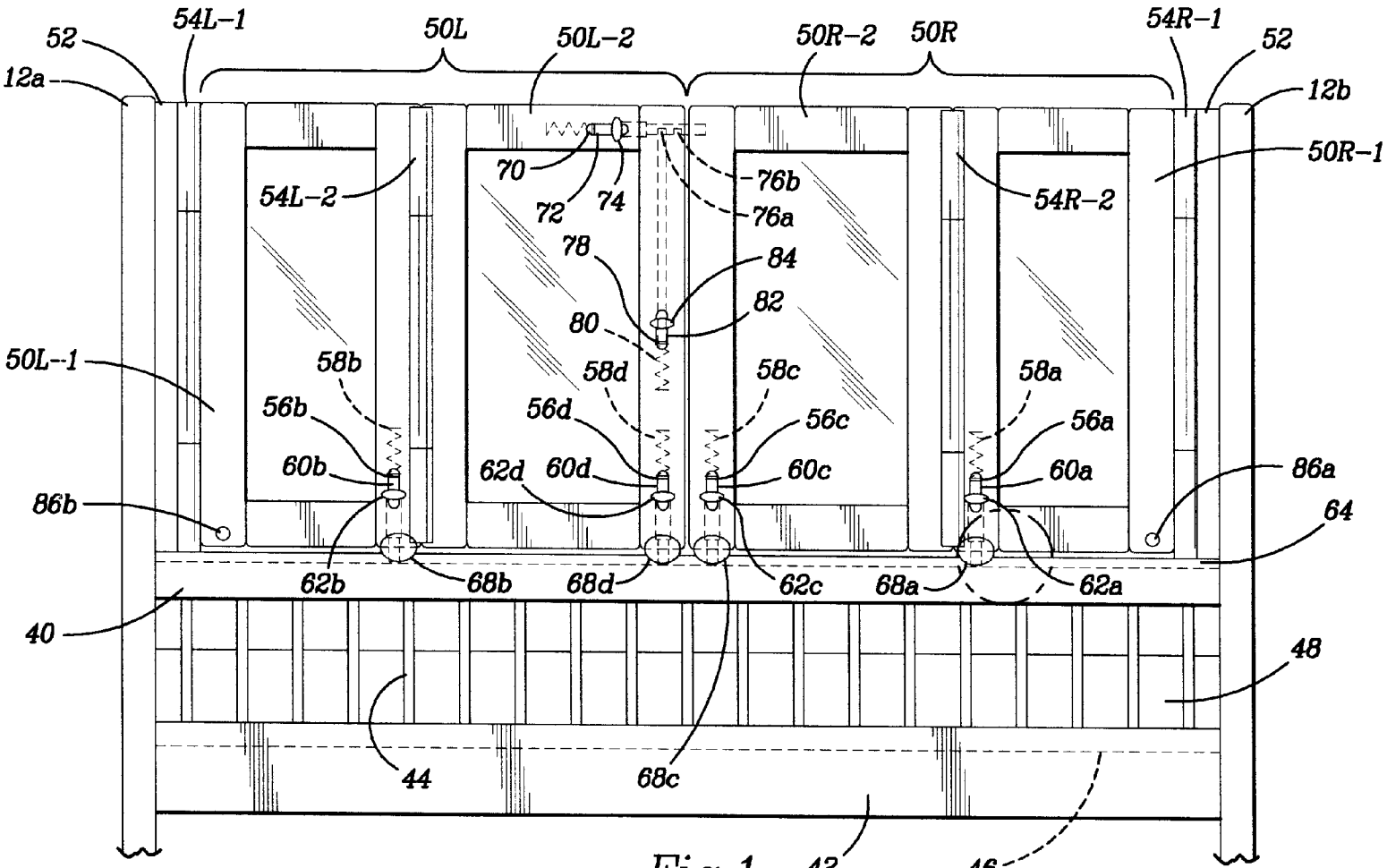
FIG. 1 is a side plan view of the infant crib of the present invention showing the paired sets of vertically hinged doors extending along an entire sidewall of the crib.

With reference to FIG. 1, the upper section of the front wall 20 is composed of two sets of paired doors, a right side door set 50R and a left side door set 50L. Between each corner post 12*a* and 12*b* and the right and left side door sets 50R, 50L are mounting blocks 52 to which the outer cylindrical hinges 54R-1, 54L-1 are mounted. The outer doors 50R-1 and 50L-1 of each of the door sets 50R, 50L are also mounted to the outer cylindrical hinges 54R-1, 54L-1 along their vertical sides closest to the corner posts 12*a*, 12*b*. The outer cylindrical hinges 54R-1, 54L-1 extend along the entire vertical distance of each door 50R-1, 50L-1 and the opposing mounting block 52. The space between the outer surface of each hinge 54R-1, 54L-1 and the opposing mounting block 52, and the space between the hinge 54R-1, 54L-1 and the opposing door 50R-1, 50L-1 is on the order of less than 0.125 inches, much less than the space that any finger could penetrate and become trapped. The design of the hinge as an elongated cylinder provides for the ease of movement of the doors 50R-1, 50L-1 about the hinge such that the respective doors will open to at least a perpendicular position that will be described more fully with reference to FIG. 3.

Figure 3:
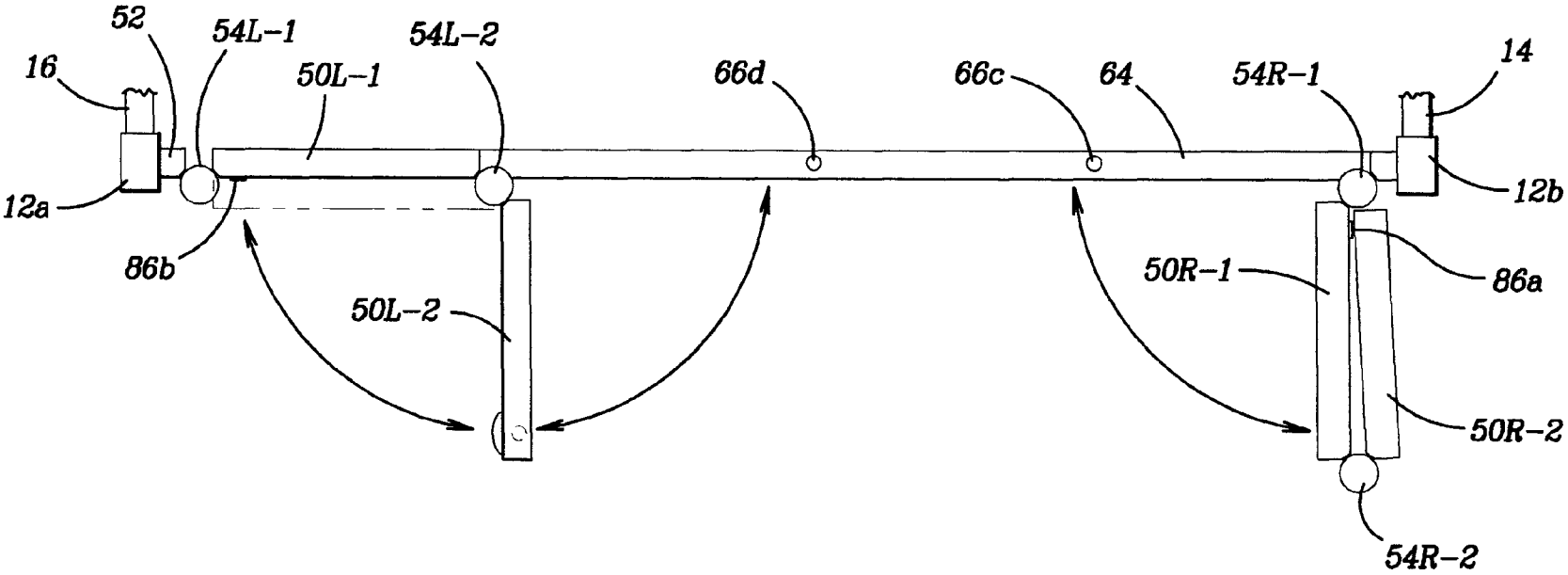
FIG. 3 is a top view of the sidewall of the infant crib of the present invention showing the paired sets of vertically hinged doors in various operational states.

The doors 50R-1, 50L-1 extend upward from the lower section of the front wall 20 to a height equivalent to the rear wall 18 relative to the corner posts 12*a-d*. Each of the doors in the door sets 50R, 50L are constructed of a frame surrounding a rectangular shatterproof transparent center piece for viewing the bed space of the infant crib 10. The doors 50R-1 and 2 and 50L-1 and 2 are approximately of the same width dimension and are separated by another vertically mounted elongated cylindrical hinge 54R-2, 54L-2 that extends the entire distance from the bottom to the top of the doors as described above. However, in this instance, in view of the additional requirement for the door sets 54R, 54L to fold over each other, the hinges 54R-2, 54L-2 are mounted within opposing bevels or chamfers cut into the inward facing outer surface of each of the doors 50R-1 and 2 and 50L-1 and 2. In this manner, the operation of the doors about the hinge point permit the doors 50R-1, 50R-2 and 50L-1, 50L-2 to fold over the other of the same door set as shown in FIG. 3.

Figure 1A:
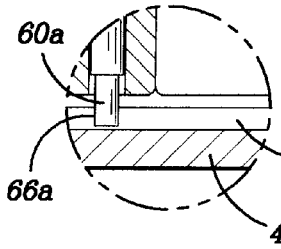
FIG. 1A is an enlarged view of the latch mechanism for retaining the right-most door in its closed and locked position.

Each of the outer doors 50R-1, 50L-1 has a latching mechanism 56*a*, 56*b* positioned at their respective inward edges. Each latching mechanism 56*a*, 56*b* is comprised of a spring 58*a*, 58*b* and a latch pin 60*a*, 60*b* with a handle 62*a*, 62*b* that protrudes outward through each of the doors 50R-1, 50L-1. The latch pins 60*a*, 60*b* are attached to the bottom ends of the springs 58*a*, 58*b* and are housed within vertical bores in each of the doors 50R-1, 50L-1 extending upward from their bottom surfaces. The springs 58*a*, 58*b* exert a downward force on the latch pins 60*a*, 60*b* such that the pins extend through the bottom of the doors 50R-1, 50L-1, and into a coaxially aligned cylindrical recess 66*a* (66*b* not shown) in the top rail reinforcement 64 covering the upper rail 40 of the lower section of the front wall 20. In this manner, the latch pins 60*a*, 60*b* are constantly extending downward and outward from the bottom of the doors 50R-1, 50L-1 by the spring force unless manually raised to release the door from its closed and locked position or to reposition the door in its closed and locked position. FIG. 1A shows the latch pin 60*a* extending into the cooperating recess 66*a* in the upper rail 40 of the lower section of the front wall 20. The outer surface of doors 50R-1, 50L-1, along the inner bottom edge, carry a stop 68*a*, 68*b* that prevents the doors from being folded inward into the crib bed space stopping the door in alignment with the top rail reinforcement 64. The stops 68*a*, 68*b* extend downward over the top rail reinforcement 64 assisting in retaining the paired door sets 50R, 50L in vertical alignment with the lower section to form the front wall 20 of the infant crib 10.

As in the case of the outer doors, each of the inner doors 50R-2, 50L-2 also has a latching mechanism 56*c*, 56*d* positioned at their respective inward edges. Each latching mechanism 56*c*, 56*d* is comprised of a spring 58*c*, 58*d* and a latch pin 60*c*, 60*d* with a handle 62*c*, 62*d* that protrudes outward through each of the doors 50R-2, 50L-2. The latch pins 60*c*, 60*d* are attached to the bottom ends of the springs 58*c*, 58*d* and are housed within vertical bores in each of the doors 50R-2, 50L-2 extending upward from their bottom surfaces. The springs 58*c*, 58*d* exert a downward force on the latch pins 60*c*, 60*d* such that the pins extend through the bottom of the doors 50R-2, 50L-2, and into respective coaxially aligned cylindrical recesses 66*c*, 66*d* in the top rail reinforcement 64 covering the upper rail 40 of the lower section of the front wall 20. In this manner, the latch pins 60*c*, 60*d* are constantly extending downward and outward from the bottom of the doors 50R-2, 50L-2 by the spring force unless manually raised to release the door from its closed and locked position or to reposition the door in its closed and locked position. The outer surface of doors 50R-2, 50L-2, along the inner bottom edge, carry a stop 68*c*, 68*d* that prevents the doors from being folded inward into the crib bed space stopping the door in alignment with the top rail reinforcement 64. The stops 68*c*, 68*d* extend downward over the top rail reinforcement 64 assisting in retaining the paired door sets 50R, 50L in alignment to form the front wall 20 of the infant crib 10. The distance between the bottom of the doors 50R, 50L and the top rail reinforcement 64 is approximately less than 0.125 inches so that there can be no entrapment of little hands or fingers between the doors and the fixed lower section of the front wall 20 of the infant crib 10.

Along the top of the inner doors 50R-2, 50L-2 is a separate horizontally oriented slide latch mechanism 70 comprised of a latch pin 72 that extends outward from door 50L-2 and into a cooperating aligned bore in door 50R-2. The latch pin carries handle 74 that extends outward from the surface of door 50L-2. Since this slide latch mechanism 70 could possibly be reached from the interior of the crib space, a locking mechanism 78 mounted vertically within the innermost frame section of door 50L-2 is used to retain the latch mechanism 70 in a first locked position or a second unlocked position. The locking mechanism 78 is comprised of a spring 80 attached to an elongated locking pin 82 that extends upward through the frame of door 50L-2 and comes into contact with the latch pin 72. The distal end of locking pin 82 mates with either of two cutouts 76*a*, 76*b* that correspond to the locked and unlocked positions of slide latch mechanism 70, respectively. The handle 84 of locking mechanism 78 extends outward from the door 50L-2 and is operable by moving the handle 84 and locking pin 82 downward against the spring force of spring 80 removing the distal end of locking pin 82 from the latch pin 74. The latch pin 74 is then moved right or left, depending upon the desired action of locking or unlocking the latch, and the locking pin 82 is returned to either of the two cutouts 76*a*, 76*b*. With the locking pin 82 extending into the cutout 76*b*, the slide latch mechanism 70 will be in the open position with the latch pin 74 retracted into door 50L-2. With the locking pin extending into cutout 76*a*, the slide latch mechanism 70 will be in the closed and locked position with the latch pin extending outward from door 50L-2 and into the cooperating bore in door 50R-2 creating a joined top rail for the front wall 20. The release of the handle 84 of the locking mechanism 78 causes the locking pin 82 to engage the latch pin 74 in either of the cutouts 76*a*, 76*b* retaining the latch pin 74 in that position until the locking mechanism 78 is reengaged to reverse the procedure. The distance between the inner doors 50R-2, 50L-2 is also approximately less than 0.125 inches so as to avoid any entrapment or pinching injury by the occupant of the infant crib 10.

Utilizing the structure described above, particularly the doors 50R, 50L comprising the upper section of front wall 20 of the infant crib 10, access to the bed space of the crib 10 is easily achieved without bending or straining over a non-moveable crib wall. Access is also easier in that the release mechanisms are placed more towards the center of the front wall 20 rather than at the corner posts as is the situation with currently available fold-down side cribs. Referring now to FIG. 3, the operability of the upper section of the sidewall 20 will be described in greater detail. To gain access to the bed space of the infant crib 10, one must operate the latching system described above in connection with each of the paired sets of doors 50R, 50L. Each of the doors has a separate latch mechanism 56*a-d* as well as a door locking mechanism 70, 78 extending between the inner doors 50R-2, 50L-2. Following the release of the locking mechanism 70, 78 and the retraction of the latch pin 72, the doors 50R-2, 50L2 are ready for unlatching. Either of these doors can be unlatched, for example, door 50L-2 may be unlatched and rotated about elongated cylindrical hinge 54L-2 to a 90° open position as shown in FIG. 3. This operation gives immediate access to the bed space of the infant crib 10. If greater access is desired, door 50R-2 can be unlatched and folded over its paired outer door 50R-1 and secured in place by magnet 86*a* to retain the door 50R-2 in a folded overlapping position to door 50R-1. The magnet cooperates with the stop 68*c* such that until a sharp tug by the user the door 50R-2 will remain in position against door 50R-1. If still greater access is required to the bed space of the infant crib 10, the outer door 50R-1 can be released by operating the latch mechanism 56*a* and the doors 50R-1, 50R-2 rotated outward about the elongated cylindrical hinge 54R-1 as far outward as desired. Depending upon whether the hinge 54R-1 is mounted directly between flat surfaces of the door 50R-1 and the cooperating mounting block 52, or mounted in a bevel or chamfer of the door edge of door 50R-1, the door will rotate outward at least 90° with a greater angle of opening possible if the hinge 54R-1 is mounted to a chamfer on the door 54R-1. The other door set is also capable of folding over one another as shown in the phantom lines to the left side of FIG. 3 for total access to the bed space. A cooperating magnet 86*b* is positioned in the lower left corner of door 50L-1 to retain the stop 68*d* of door 50L-2 against it and retain the doors in folded over position until tugged apart. The described actions taken in reverse order for each of the doors 50R, 50L will reposition these doors with the latch mechanisms 56*a-d* and the locking mechanism 70, 78 engaged and the sidewall 20 fixed in position above the rigid lower section creating a substantially rigid upper section of the front wall 20.

Figure 4:
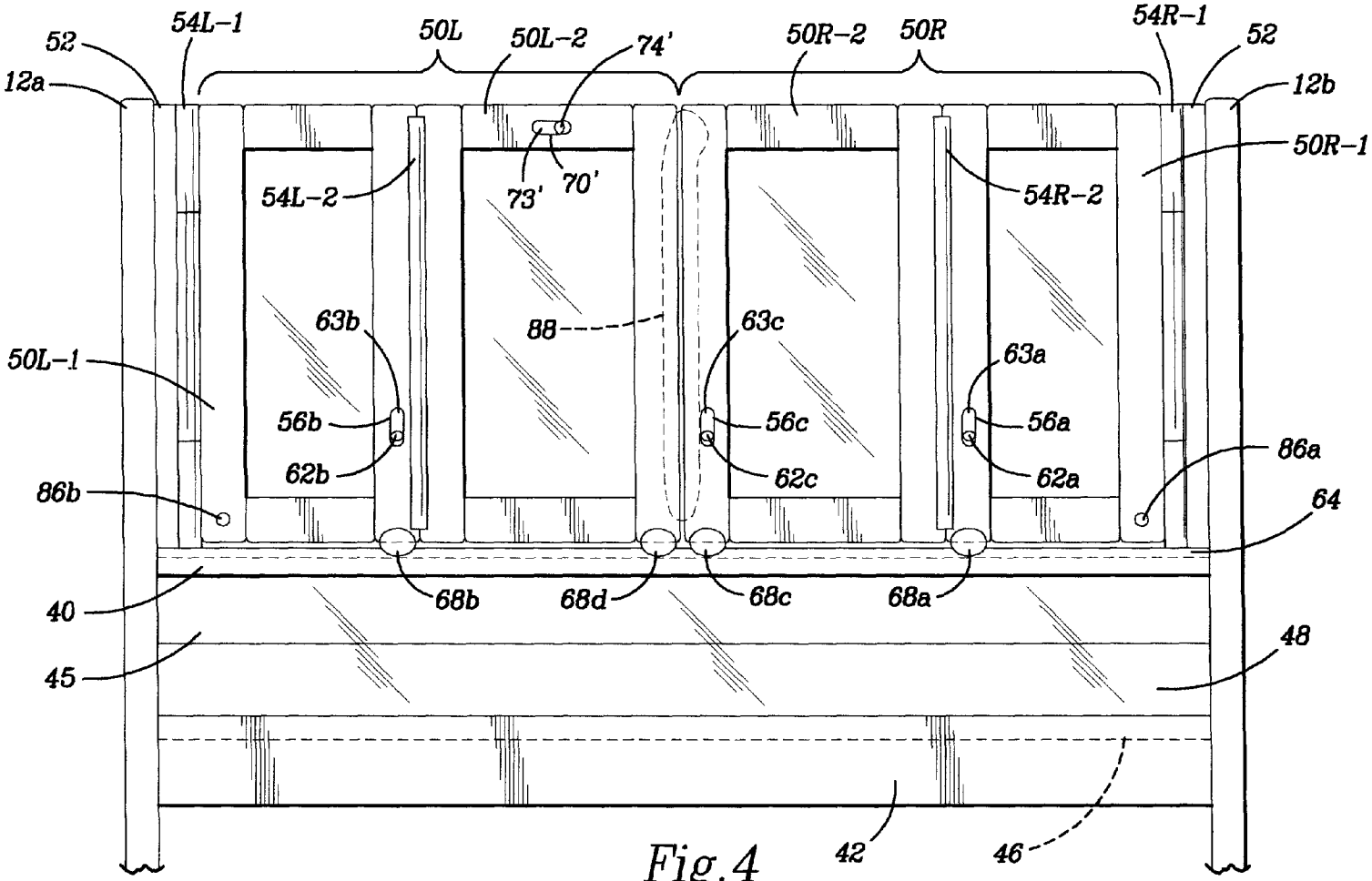
FIG. 4 is a side plan view of the infant crib showing an alternative locking arrangement for the paired sets of vertically hinged doors.

Alternatively, the door sets 50L and 50R can be configured with a different, and easier to operate, latching system. Referring to FIG. 4, the upper section of the front wall 20 is composed of two sets of paired doors, a right side door set 50R and a left side door set 50L. Between each corner post 12*a* and 12*b* and the right and left side door sets 50R, 50L are mounting blocks 52 to which the outer cylindrical hinges 54R-1, 54L-1 are mounted. As above, the outer doors 50R-1 and 50L-1 of each of the door sets 50R, 50L are also mounted to the outer cylindrical hinges 54R-1, 54L-1 along their vertical sides closest to the corner posts 12*a*, 12*b*. The outer cylindrical hinges 54R-1, 54L-1 extend along the entire vertical distance of each door 50R-1, 50L-1 and the opposing mounting block 52. The space between the outer surface of each hinge 54R-1, 54L-1 and the opposing mounting block 52, and the space between the hinge 54R-1, 54L-1 and the opposing door 50R-1, 50L-1 is on the order of less than 0.125 inches, much less than the space that any finger could penetrate and become trapped. The design of the hinge as an elongated cylinder provides for the ease of movement of the doors 50R-1, 50L-1 about the hinge such that the respective doors will open to at least a perpendicular position that was described with reference to FIG. 3.

The doors 50R-1, 50L-1 extend upward from the lower section of the front wall 20 to a height equivalent to the rear wall 18 relative to the corner posts 12*a-d*. Each of the doors in the door sets 50R, 50L are constructed of a frame surrounding a rectangular shatterproof transparent center piece for viewing the bed space of the infant crib 10. The doors 50R-1 and 2 and 50L-1 and 2 are approximately of the same width dimension and are separated by another vertically mounted elongated cylindrical hinge 54R-2, 54L-2 that extends the entire distance from the bottom to the top of the doors as described above. As discussed above, in view of the additional requirement for the door sets 54R, 54L to fold over each other, the hinges 54R-2, 54L-2 are mounted within opposing bevels or chamfers cut into the inward facing outer surface of each of the doors 50R-1 and 2 and 50L-1 and 2. In this manner, the operation of the doors about the hinge point permit the doors 50R-1, 50R-2 and 50L-1, 50L-2 to fold over the other of the same door set as shown in FIG. 3.

Each of the outer doors 50R-1, 50L-1 has a latching mechanism 56*a*, 56*b* positioned at their respective inward edges that is operated in the same manner as described above. The only change is that the latch handle 62*a*, 62*b* is recessed within a cooperating cutout 63*a*, 63*b* in the respective door 50R-1 and 50L-1. The outer surface of doors 50R-1, 50L-1, along the inner bottom edge, carry a stop 68*a*, 68*b* that prevents the doors from being folded inward into the crib bed space stopping the door in alignment with the top rail reinforcement 64. The stops 68*a*, 68*b* extend downward over the top rail reinforcement 64 assisting in retaining the paired door sets 50R, 50L in vertical alignment with the lower section to form the front wall 20 of the infant crib 10. The lower section of the front wall, as shown in FIGS. 4 and 5 is comprised of a rectangular shatterproof transparent view piece 45 that is mounted in place of the spindles 44 of the other embodiment of FIG. 1.

In this alternative latching arrangement, only inner door 50R-2 has a latching mechanism 56*c* positioned at its inward edge that is operated in the same manner as described above. The only change is that the latch handle 62*c* is recessed within a cooperating cutout 63*c* in the door 50R-1 as shown in FIG. 4. The outer surface of doors 50R-2, 50L-2, along the inner bottom edges, also carry a stop 68*c*, 68*d* that prevents the doors from being folded inward into the crib bed space stopping the door in alignment with the top rail reinforcement 64. The stops 68*c*, 68*d* extend downward over the top rail reinforcement 64 assisting in retaining the paired door sets 50R, 50L in alignment to form the front wall 20 of the infant crib 10. The distance between the bottom of the doors 50R, 50L and the top rail reinforcement 64 is approximately less than 0.125 inches so that there can be no entrapment of little hands or fingers between the doors and the fixed lower section of the front wall 20 of the infant crib 10.

Figure 5:
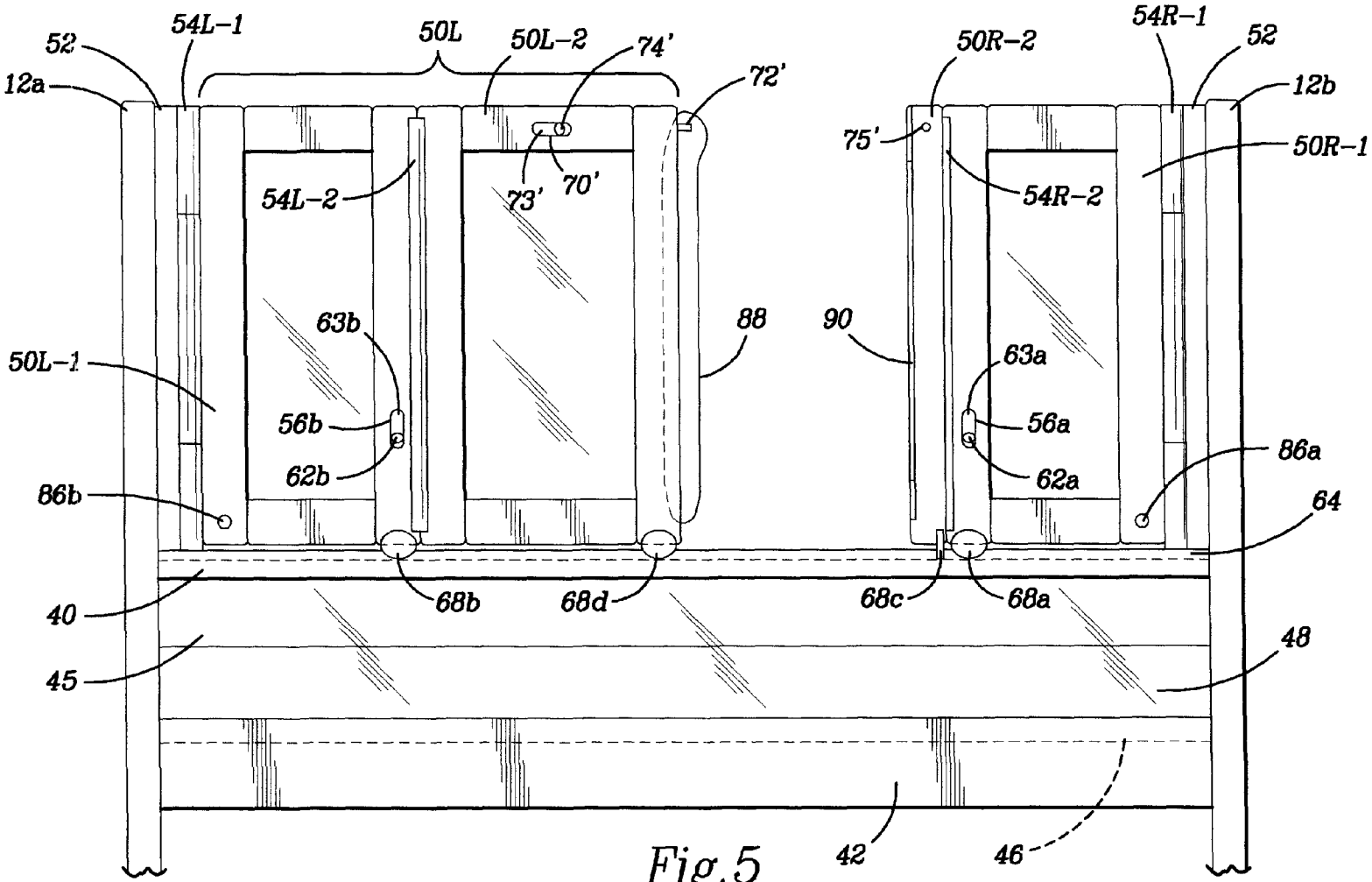
FIG. 5 is a side view of the infant crib of FIG. 4 with the right center door in the open position to show the top latch extension and the cooperating backstop and matching cutout of the two center doors.

Along the top of the inner door 50L-2 is a separate horizontally oriented latching mechanism 70' comprised of a latch pin 72' that extends outward from door 50L-2 and into a cooperating aligned receiver 75' in door 50R-2 as shown in FIG. 5 for engagement with door 50R-2 and be in its locked position. The latch pin carries handle 74' that is recessed within a cooperating cutout 73' in the door 50L-1 as shown in FIG. 4. Since this slide latch mechanism 70' could possibly be reached from the interior of the crib space, an operational interlocking occurs with the latching mechanism 56*c* housed in the right center door 50R-2. An additional backstop 88 is added along the inward facing interior edge of door 50L-2 that extends rightward toward door 50R-2. A cooperating cutaway bevel 90 along the rear inner surface of door 50R-2 mates precisely with the backstop 88. With the doors 50R-2, 50L-2 in the closed position, and with the latching mechanism 56*c* engaged, even in the event that the slide latch 70' is disengaged from door 50R-2, door 50L-2 is prevented from being opened by door 50R-2 remaining latched and blocking the outward passage of backstop 88 past the opposing door 50R-2. Likewise, door 50L-2 cannot be pulled inward into the crib because the stop 68*d* prevents movement in that direction as well. With the alternative latching system described immediately above the distance between the inner doors 50R-2, 50L-2 is virtually non-existent so entrapment or pinching injury by the occupant of the infant crib 10 is unlikely.

With the alternative latching system, in order to operate the center doors 50R-2, 50L-2 to gain entry to the crib space, the slide latch 70' is moved to the left from its rightward locking position, the spring latch 56*c* in door 50R-2 is released and door 50R-2 is swung outward releasing door 50L-2 for outward movement. Door 50L-2 is then moved outward and the crib space becomes fully accessible to the parent or caregiver. To lock the doors 50R-2, 50L-2, door 50L-2 is swung to its closed position, door 50R-2 is swung to its closed position and latch 56*c* is engaged, and slide latch 70' is moved rightward to complete the interlocking engagement of the two doors.

In the manner described above, access to the bed space of the infant crib can be small or as large as the parent or caretaker desires. The doors are maintained with the latch mechanism extended until retracted for release for access or for securing when closing the door and recreating the front wall. The unlocking of the upper latch mechanism across the top of the two centrally oriented doors requires either the simultaneous action of retracting the latch pin and sliding the locking pin inward or outward depending upon the desire to open or secure the doors or the alternative interlocking as described immediately above. All of the latch release handles are accessible only from the exterior of the crib and are located on the doors in positions that are not readily accessible from inside the crib. When the doors arrayed across the front wall opening of the crib are secured to the lower section and, at the center, to each other, the front wall again becomes a rigid structure similar in strength to the other wall of the infant crib.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. An infant crib having top and bottom sides, rear and front sides and a sleep surface support deck connected between respective corner posts creating a bed space therebetween, the improvement comprising:

said front side extending between two of said corner posts and segregated into lower and upper sections, said lower section including a lower rail and an upper rail extending between and connected to said corner posts with an egress barrier spanning the vertical distance between the lower and upper rails, said upper section including a plurality of doors extending across the space between the corner posts, each of said plurality of doors having along its edge closer to the nearest corner post an elongate cylindrical hinge for mounting to said corner post and being operable to open outward from and provide access to the bed space of said crib;

said plurality of doors including latching means for securing the plurality of doors in a closed straight-line arrangement creating a substantially rigid upper front wall section of said infant crib.

2. The infant crib of claim 1, wherein said latching means for securing the plurality of doors includes a spring operated latch pin that secures at least three of said plurality of doors into a cooperating coaxially aligned receiving bore positioned in a reinforcing member atop the upper rail of the lower section.

3. The infant crib of claim 2, wherein said latching means is mounted within said at least three of said plurality of doors and is manually operable by a handle extending to the surface of the door such that each latch pin can be retracted from said receiving bore and into each of said plurality of doors releasing each of said at least three of said doors for outward rotational movement about said elongated hinges.

4. The infant crib of claim 1, wherein said latching means for securing the plurality of doors includes an interlocking locking and release means comprising a cooperating slide lock and an inwardly extending backstop along the rear inward facing edge of a first one of the center doors of the plurality of doors with a coaxially aligned receiver for accepting the extended pin of the slide lock and a cutaway bevel for receiving the backstop along the rear inward facing edge of a second one of said center doors of the plurality of doors and a spring operated latch pin mounted within the second one of said center doors with a coaxially aligned receiving bore positioned in a reinforcing member atop the upper rail of the lower section that secures the inward most edges of the plurality of doors to each other in said closed straight-line arrangement.

5. The infant crib of claim 4, wherein said cooperating slide lock is manually operable by a handle extending to the surface of the first one of said center doors such that said slide lock can be retracted from said coaxially aligned receiver in the second one of said center doors situated in adjacent edge abutting position to said first one of said center doors for partially releasing said doors for outward rotational movement about said elongated hinges.

6. The infant crib of claim 4, wherein said spring operated latch pin is manually operable by a handle extending to the surface of the door such that the latch pin can be retracted from said receiving bore and into said second one of said center doors releasing the second one of said center doors for outward rotational movement about said elongated hinge.

7. The infant crib of claim 1, wherein said plurality of doors each have a stop for preventing said plurality of doors from being pushed into the bed space of the infant crib, each of said stops is positioned along the lower edge close to the inward facing edge of each of said plurality of doors extending downward beyond the lower edge of said plurality of doors to contact a reinforcing member atop the upper rail of the lower section stopping each of said plurality of doors in alignment with the reinforcing member.

8. A displaceable side wall of an infant crib comprising:

a lower section and an upper section;

said lower section including a lower rail and an upper rail extending between and connected to adjacent corner posts of said crib with an egress barrier spanning the vertical distance between the lower and upper rails;

said upper section including a plurality of doors extending across the space between the corner posts, each said door capable of outward rotational movement about an attached elongated cylindrical hinge;

said plurality of doors including latching means for securing the plurality of doors in a closed straight-line arrangement creating a substantially rigid upper section of the side wall of said infant crib.

9. The displaceable side wall of claim 8, wherein the plurality of doors are segregated into two opposite-hand opening groups of bi-fold doors, each of said groups of bi-fold doors having inner and outer doors, each of said inner and outer doors having along its edge closer to the nearest corner post an elongate cylindrical hinge for mounting to said adjacent door of said bi-fold door group or to said adjacent corner post and being operable about said elongate cylindrical hinge to open outward from and provide access to the bed space of said crib.

10. The infant crib of claim 8, wherein said latching means for securing the plurality of doors includes a spring operated latch pin that secures at least three of said plurality of doors into a cooperating coaxially aligned receiving bore positioned in a reinforcing member atop the upper rail of the lower section.

11. The infant crib of claim 10, wherein said latching means is mounted within each of said at least three of said plurality of doors and is manually operable by a handle extending to the surface of the door such that each latch pin can be retracted from said receiving bore and into each of said at least three of said plurality of doors releasing each of said doors for outward rotational movement.

12. The infant crib of claim 8, wherein said latching means for securing the plurality of doors includes an interlocking locking and release means comprising a cooperating slide lock and an inwardly extending backstop along the rear inward facing edge of a first one of the center doors of the plurality of doors with a coaxially aligned receiver for accepting the extended pin of the slide lock and a cutaway bevel for receiving the backstop along the rear inward facing edge of a second one of said center doors of the plurality of doors and a spring operated latch pin mounted within the second one of said center doors with a coaxially aligned receiving bore positioned in a reinforcing member atop the upper rail of the lower section that secures the inward most edges of the plurality of doors to each other in said closed straight-line arrangement.

13. The infant crib of claim 12, wherein said cooperating slide lock is manually operable by a handle extending to the surface of the first one of said center doors such that said slide lock can be retracted from said coaxially aligned receiver in the second one of said center doors situated in adjacent edge abutting position to said first one of said center doors for partially releasing said doors for outward rotational movement about said elongated hinges.

14. The infant crib of claim 12, wherein said spring operated latch pin is manually operable by a handle extending to the surface of the door such that the latch pin can be retracted from said receiving bore and into said second one of said center doors releasing the second one of said center doors for outward rotational movement about said elongated hinge.

15. The infant crib of claim 9, wherein said latching means for securing the plurality of doors includes an interlocking locking and release means comprising a cooperating slide lock and an inwardly extending backstop along the rear inward facing edge of a first one of the center doors of the plurality of doors with a coaxially aligned receiver for accepting the extended pin of the slide lock and a cutaway bevel for receiving the backstop along the rear inward facing edge of a second one of said center doors of the plurality of doors and a spring operated latch pin mounted within the second one of said center doors with a coaxially aligned receiving bore positioned in a reinforcing member atop the upper rail of the lower section that secures the inward most edges of the plurality of doors to each other in said closed straight-line arrangement.

16. The infant crib of claim 15, wherein said cooperating slide lock is manually operable by a handle extending to the surface of the first one of said center doors such that said slide lock can be retracted from said coaxially aligned receiver in the second one of said center doors situated in adjacent edge abutting position to said first one of said center doors for partially releasing said doors for outward rotational movement about said elongated hinges.

17. The infant crib of claim 15, wherein said spring operated latch pin is manually operable by a handle extending to the surface of the door such that the latch pin can be retracted from said receiving bore and into said second one of said center doors releasing the second one of said center doors for outward rotational movement about said elongated hinge.

18. The infant crib of claim 8, wherein said plurality of doors each have a stop for preventing said plurality of doors from being pushed into the bed space of the infant crib, each of said stops is positioned along the lower edge close to the inward facing edge of each of said plurality of doors extending downward beyond the lower edge of said plurality of doors to contact a reinforcing member atop the upper rail of the lower section stopping each of said plurality of doors in alignment with the reinforcing member.

19. The infant crib of claim 9, wherein said opposite-hand opening groups of bi-fold doors each have a stop for preventing said individual doors from being pushed into the bed space of the infant crib, each of said stops is positioned along the lower edge close to the inward facing edge of each of said doors extending downward beyond the lower edge of said doors to contact a reinforcing member atop the upper rail of the lower section stopping each of said doors in alignment with the reinforcing member.

20. The infant crib of claim 9, wherein the outer doors of said groups of bi-fold doors have retention means for retaining the stop mounted to the inner door of the bi-fold doors in close proximate attachment when the bi-fold doors are overlaid one against the other.

* * * * *